United States Patent [19]

McConnell, Jr.

[11] Patent Number: 4,588,137

[45] Date of Patent: May 13, 1986

[54] VIBRATORY CRUSHER

[76] Inventor: David P. McConnell, Jr., 1515 S. Extension Rd., Apt. #2164, Mesa, Ariz. 85202

[21] Appl. No.: 584,325

[22] Filed: Feb. 28, 1984

[51] Int. Cl.[4] ..... B02C 2/04

[52] U.S. Cl. ..... 241/156; 241/208

[58] Field of Search ..... 241/30, 30 D, 156, 285 R, 241/207–216

[56] References Cited

U.S. PATENT DOCUMENTS

| | | | |
|---|---|---|---|
| 2,190,036 | 2/1940 | Morch | 241/208 X |
| 2,635,818 | 4/1953 | Zoerb | 241/156 X |
| 4,434,944 | 3/1984 | Bodine | 241/208 X |

*Primary Examiner*—Mark Rosenbaum

*Attorney, Agent, or Firm*—John A. Bucher

[57] ABSTRACT

A vibratory crusher and method of operation are disclosed wherein an elongated mandrel has a rotatable shaft extending along its axis with eccentric masses mounted in balanced and opposed offset relation on opposite ends of the shaft, the mandrel being supported in a manner permitting floating gyratory motion of its ends which are arranged in spaced apart relation within first and second relatively fixed reaction collars or cones, the shaft being driven in rotation whereby the eccentric masses cause the ends of the mandrel to gyrate relative to the reaction collars or cones for producing a vibratory crushing effect therebetween.

19 Claims, 5 Drawing Figures

VIBRATORY CRUSHER

BACKGROUND OF THE INVENTION

The present invention relates to a crushing machine and method of operation and more particularly to such a crushing machine of a vibratory rotating type which is adapted for efficient crushing operation at a rate comparable to that of conventional crushers of substantially greater size, weight and bulk while using considerably less power than such conventional crushers.

Conventional rotating vibratory crushers of the type referred to above are generally formed with a rotor driven in positive eccentric fashion relative to a surrounding stator. The stator commonly has a cone shaped configuration, a crushing effect being produced between the rotor and stator. Within such a crusher, the positive eccentric drive of the rotor relative to the stator introduces a number of problems. Initially, it is necessary to provide very heavy mountings between the rotor and stator in order to resist the positive eccentric drive force applied to the rotor. At the same time, the positive drive for the rotor often causes damage or plugging within the crusher when material such as metal enters between the rotor and stator. Since such metallic objects and the like are sufficiently ductile to resist crushing, their presence within the crusher usually tends to either cause damage to a portion of the crusher or to plug the crusher and prevent its continued operation.

At the same time, such conventional cone type crushers are generally inefficient because of the need to provide the positive eccentric drive for the rotor relative to the fixed stator.

Reference is also made to another type of vibratory crusher described particularly within U.S. Pat. No. 3,079,096 entitled CRUSHING APPARATUS and issued Feb. 26, 1963 to David P. McConnell, father of the inventor herein.

That patent discloses a vibratory jaw type crusher wherein a pair of opposed crusher jaws are mounted on a frame for floating vibratory movement toward and away from each other, eccentric drive forces being applied to the jaws for effecting a synchronized vibratory movement of the jaws in order to develop a powerful crushing action therebetween with relatively low power requirements. More particularly, the jaws are driven by shafts with eccentric weights arranged upon the shafts so that the jaws have a gyratory vibrating movement upwardly in unison away from one another and downwardly in unison toward one another in a manner causing particles being crushed between the jaws to be moved in a downward direction, thereby resulting in the desired crushing action at a particularly effective rate.

Although the vibratory jaw crusher referred to above was found to perform very satisfactorily, there has been found to remain a need for an even further improved crusher having generally similar low power requirements while avoiding the need for resisting the relative reaction forces between the jaws. In addition, there has also been found to remain a need for an improved vibratory crusher having an even greater crushing rate for crushing large quantities of materials such as rock, gravel and ore.

SUMMARY OF THE INVENTION

Accordingly, it is an object of the present invention to provide a novel vibratory crusher capable of providing all or part of the advantageous characteristics described above.

More particularly, it is an object of the invention to provide an improved crusher and method of operating such a crusher wherein an elongated mandrel is formed with a rotatable shaft having eccentric masses mounted in opposed offset relation on its opposite ends, the mandrel being supported in a manner permitting floating motion of its ends which are in spaced apart relation within first and second relatively fixed reaction collars, the shaft being driven in rotation whereby the eccentric masses cause the ends of the mandrel to gyrate relative to the reaction collars for producing a vibratory crushing effect therebetween.

Preferably, the axes of the reaction collars and the mandrel are vertically arranged so that material to be crushed is capable of passing under the influence of gravity first between an upper end of the mandrel and an adjacent upper reaction collar and then between the lower end of the mandrel and an adjacent lower reaction collar in order to produce a double-pass effect within the crusher.

The crusher is preferably contemplated for operation in gravel quarries and mines for example in order to reduce rock, gravel and ore to a suitable size.

It is yet another object of the invention to provide such a crusher which is of simple and sturdy construction while consisting of relatively few parts capable of a long service life with limited replacement of parts.

It is an even further object of the invention to provide such a crusher wherein both the mandrel and reaction collars or cones are equipped with replaceable linings for crushing rock and the like, the linings being replaceably mounted thereupon to facilitate operation for the crusher over long periods of time.

It is a closely related object of the invention to provide such a rock crusher with replaceable linings wherein the various components of the crusher are mounted upon a frame structure in a manner facilitating disassembly of the crusher for replacing the linings and for other repair purposes.

Additional objects and advantages of the invention are described below with reference to the accompanying drawings or will be apparent to those skilled in the art from the description.

DESCRIPTION OF THE PREFERRED EMBODIMENTS

Figure 1:
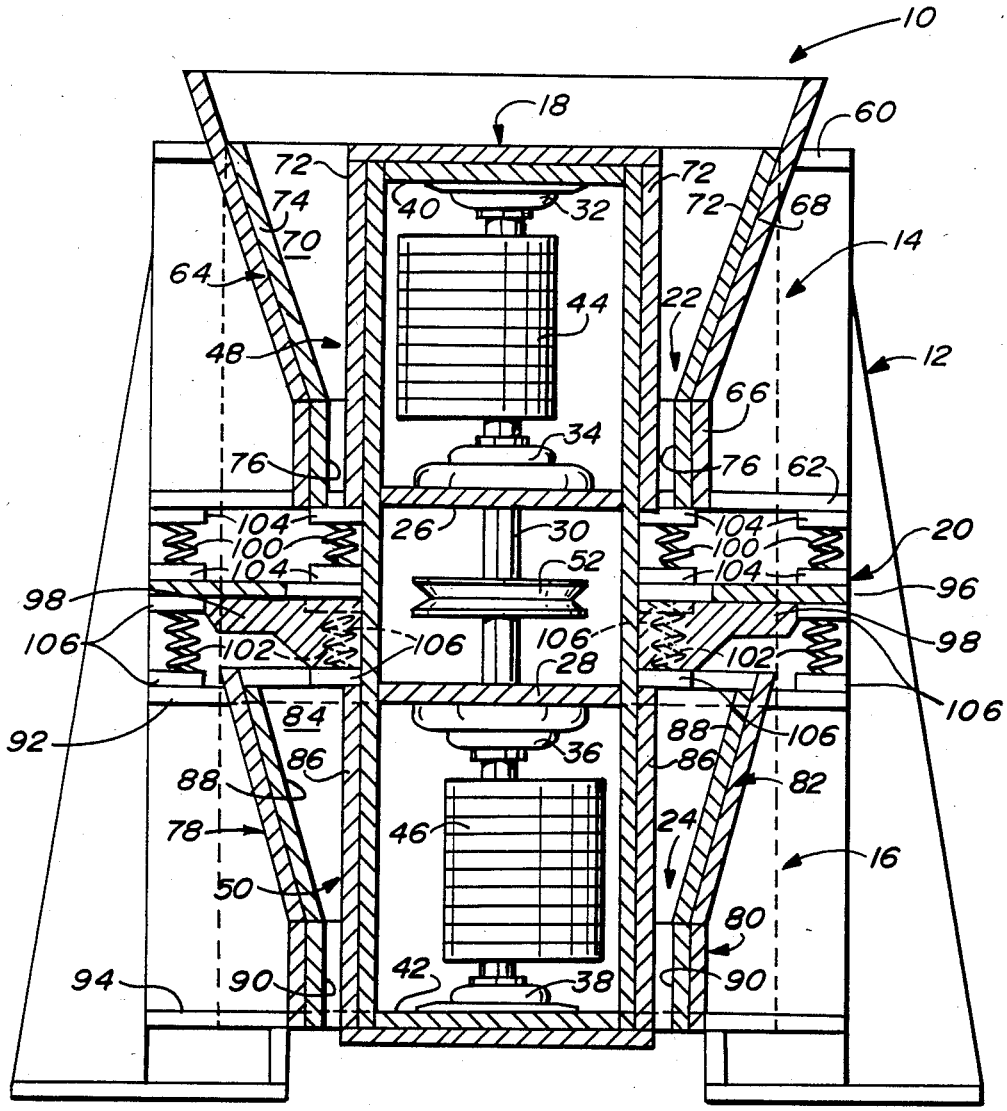
FIG. 1 is an axially sectioned side view in elevation of a vibratory crusher constructed in accordance with the present invention and adapted for operation in a manner disclosed by the invention.
Figure 2:
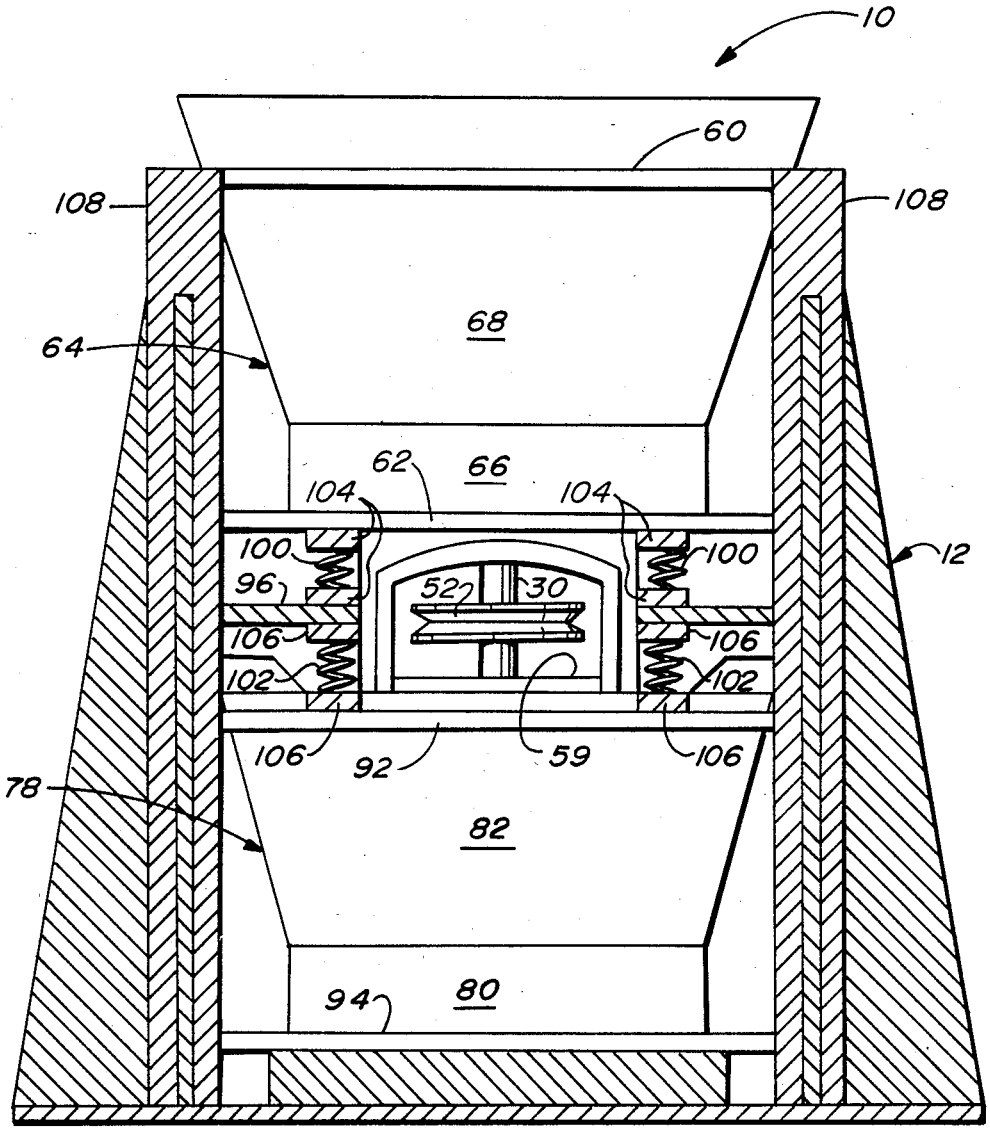
FIG. 2 is a similar side view in elevation of the crusher of FIG. 1 with only the supporting framework of the crusher being shown in section.
Figure 3:
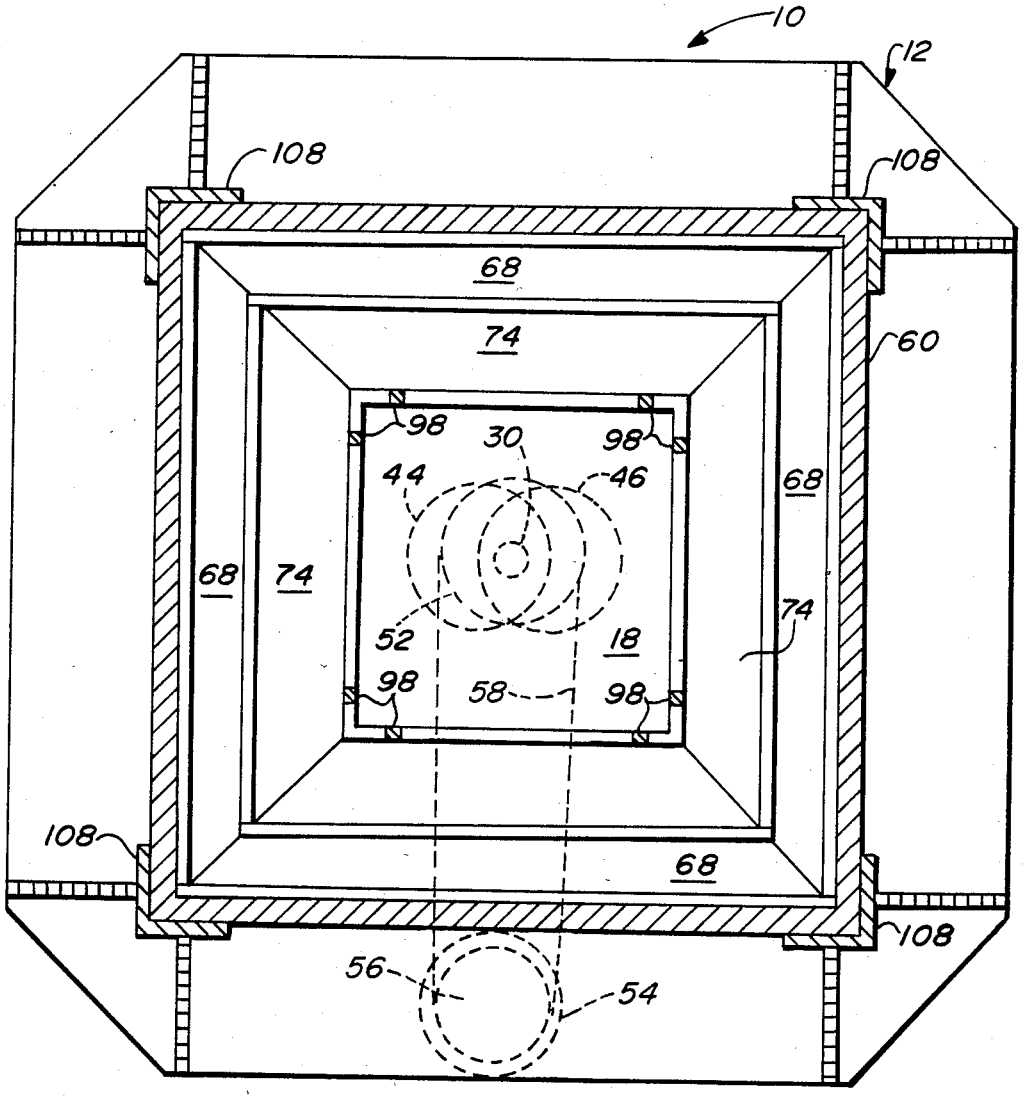
FIG. 3 is a plan view of the crusher of FIGS. 1 and 2 with parts being shown in section and other parts being shown in generally schematic fashion.
Figure 4:
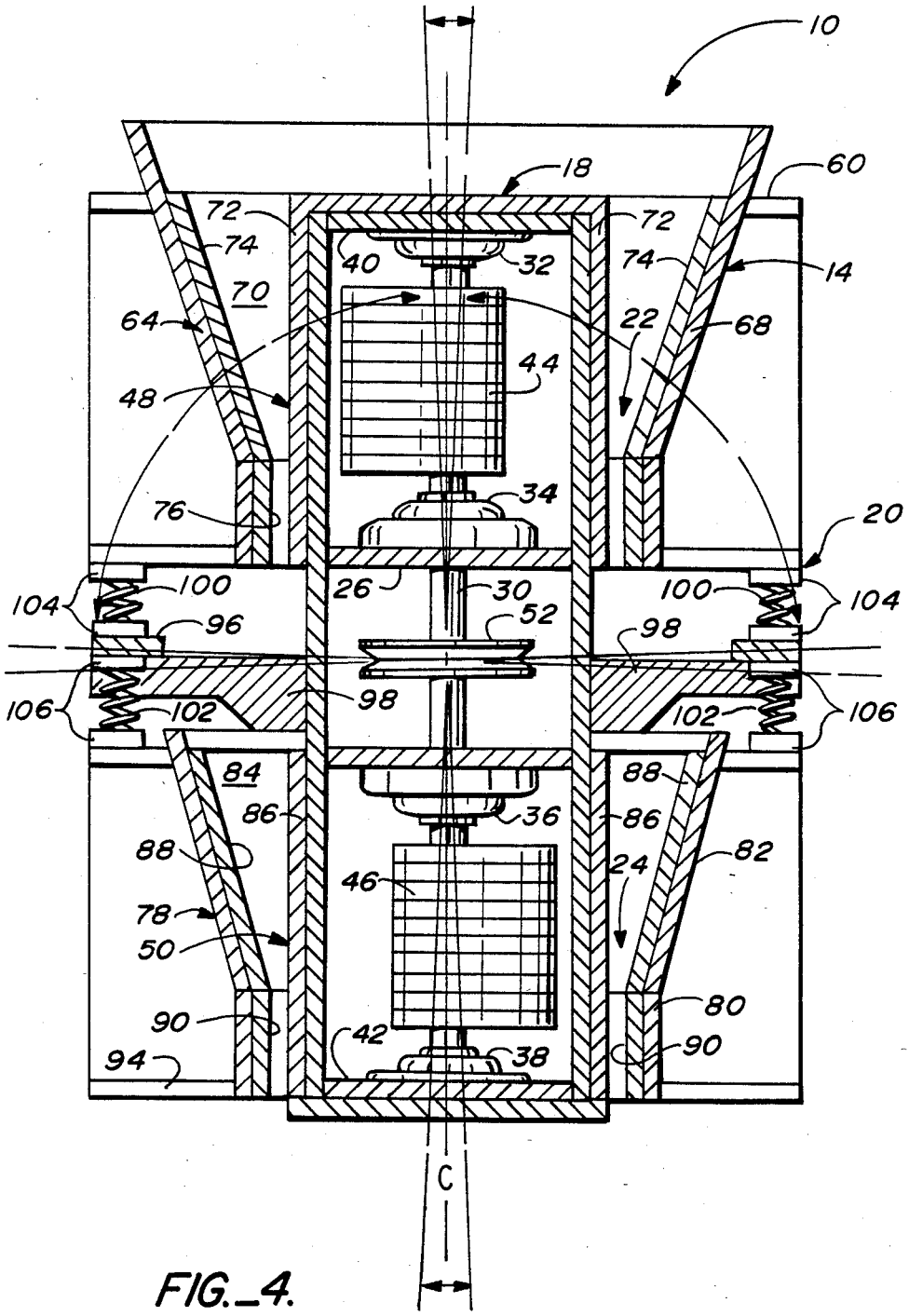
FIG. 4 is yet another view illustrating gyratory movement of a mandrel in the crusher relative to upper and lower fixed reaction collars or cones.
Figure 5:
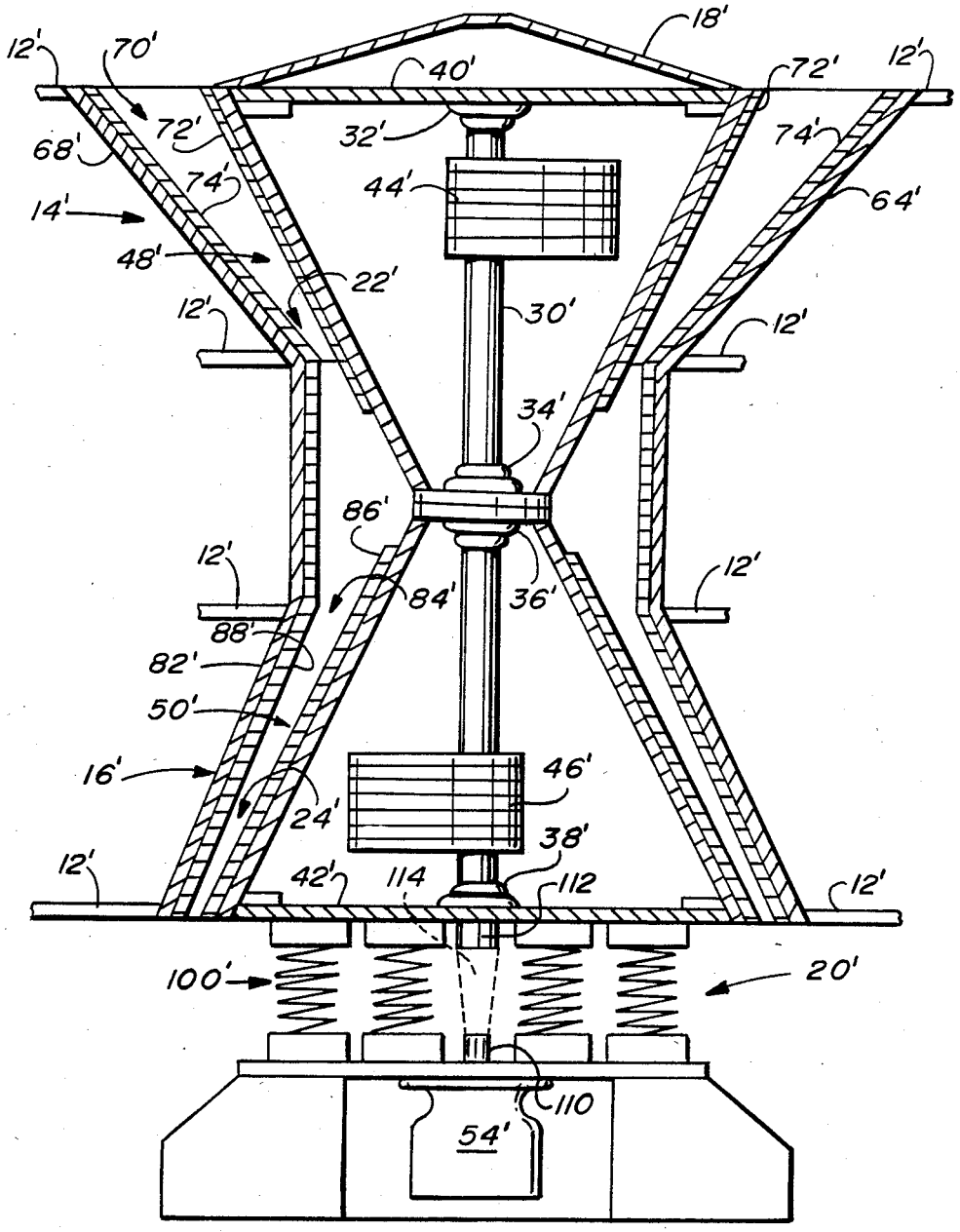
FIG. 5 is a fragmentary side view in elevation of yet another embodiment of a crusher constructed in accordance with the present invention.

Referring now to the drawings, different embodiments of vibratory crushers constructed in accordance with the present invention are illustrated respectively in FIGS. 1–4 and in FIG. 5. Major elements of the crusher in accordance with the present invention appear in each of these embodiments. Accordingly, primed numerals are employed as numerical labels for various components in the embodiment of FIG. 5, those primed numerals corresponding to numerical labels for corresponding components in FIGS. 1–4. Furthermore, the vibratory crushers illustrated in FIGS. 1–4 and in FIG. 5 are both contemplated for practicing the method of operation disclosed by the present invention.

Referring now particularly to FIGS. 1–4, the crusher embodiment represented therein and generally indicated at 10 comprises a supporting framework or structure 12 which is adapted for mounting first and second or upper and lower cones or collars 14 and 16 respectively. A mandrel 18 is of elongated construction and is supported in relatively floating relation by a mounting assembly 20 so that the mandrel 18 extends through both of the upper and lower collars 14 and 16. At the same time, the mounting assembly 20 permits the mandrel 18 to be driven in a novel manner as described in greater detail below so that both ends of the mandrel are caused to move in gyrating fashion.

Within this basic combination, the collars 14 and 16 thus provide fixed reaction surfaces. As rock, ore or other material to be crushed passes through openings 22 and 24 formed respectively by the upper and lower collars with the mandrel, the gyratory movement of the mandrel relative to the fixed surfaces of the collars 14 and 16 produces a particularly effective vibratory crushing effect. Initially, the capacity of the crusher is increased relative to conventional crushers since crushing takes place between the mandrel and both of the upper and lower collars 14 and 16. The crushing effect adjacent both of the collars 14 and 16 takes place about the entire periphery of the mandrel 18.

In addition to increasing the effective crushing effect within the crusher, the separate construction of the upper and lower collars 14 and 16 also permits the crusher 10 to function in a double-pass mode. For example, spacing between the mandrel and the upper collar 14 may be selected to accomplish an initial size reduction in rock, gravel, ore or the like while further reduced sizing is provided between the lower collar 16 and the mandrel. Thus, as the crushed rock or the like which exits the upper collar 14 passes between the lower collar 16 and the mandrel, it is reduced even further in size.

An additional feature of the crusher 10 which is of particular importance lies in the floating mount for the mandrel 18 which is provided by the assembly. As noted above and as will be described in greater detail below, the novel drive mechanism for the mandrel 18 causes the ends of the mandrel to follow a gyratory path permitted by the mounting assembly 20 without having a positive drive coupling forcing the mandrel to gyrate relative to the upper and lower collars 14 and 16. Conventional gyratory crushers commonly include such a positive drive coupling. Accordingly, if iron or other material which is not suitable for crushing were to be admitted to such a conventional crusher, it would tend to result either in breakage of a portion of the crusher or might serve to plug the crusher against continued operation. A particular advantage of the present invention results from the floating operation of the mandrel whereby, if a similar non-crushable article enters between the mandrel and either of the collars 14 and 16, the floating mounting assembly 20 permits continued operation of the drive assembly for the mandrel 18 without positively requiring gyratory movement between the mandrel and collars. However, upon removal of the non-crushable article, normal operation of the crusher 10 could be continued without damage being sustained in any portion of the crusher. The manner in which the crusher 10 achieves these advantages is made more apparent in the following description.

As noted above, unique advantages of the crusher 10 are due in large part to the manner in which the mandrel 18 is supported in floating relation by the mounting assembly 20 while being caused to follow a gyratory path adjacent each of the upper and lower collars 14 and 16. The construction of the mandrel 18 and the manner in which it is driven during operation of the crusher 10 is described immediately below. The mandrel 18 is of fabricated construction and includes internal transverse plates 26 and 28. A single drive shaft 30 extends along the axis of the elongated mandrel 18 while being supported for rotation relative to the mandrel by bearings 32–38. The upper and lower bearings 32 and 38 are mounted respectively upon end plates 40 and 42 of the mandrel. The central bearings 34 and 36 are respectively mounted upon the transverse plates 26 and 28.

In order to develop gyratory motion for the mandrel 18, eccentric masses 44 and 46 are secured to the common drive shaft 30 at its opposite ends. As may seen for example in FIG. 1, the eccentric masses 44 and 46 are arranged within the mandrel 18 respectively adjacent the upper and lower collars 14 and 16. The masses 44 and 46 are arranged in opposed offset relation relative to each other as may also be seen in FIGS. 1, 3 and 4. Thus, the masses 44 and 46 act generally as counterweights on the shaft 30. The weights of the eccentric masses 44 and 46 are also balanced relative to each other and also relative to the overall mass of the mandrel so that as the shaft 30 is driven in rotation, the combined mass of the two eccentrics 44 and 46 tends to remain in a fixed linear alignment, thus causing the opposite ends 48 and 50 of the mandrel 18 to follow generally balanced and offsetting gyratory paths relative to the upper and lower collars 14 and 16.

The amount of oscillation or angularly offset movement developed by the mandrel 18 at any instant in time is generally illustrated in FIG. 4. This effect is of course reproduced at all times as the eccentric masses 44 and 46 rotate with the mandrel. Thus, during each rotation of the shaft 30 and eccentric masses 44 and 46, the opposite ends 48 and 50 of the mandrel are caused to gyrate relative to the respective collars 14 and 16 in order to produce the novel crushing effect made possible by the present invention. In a typical application, the drive shaft 30 and eccentric masses 44 and 46 may be rotated at a speed of for example 1,400 to 2,000 rpm, depending upon the size and other particular characteristics of the crusher 10.

The shaft 30 is driven in rotation by means of a pulley 52 which is secured to the shaft at its midpoint. Referring again momentarily to FIG. 4, it may be seen that with the opposite ends of the mandrel gyrating in opposed relation, the midpoint of the shaft 30 and accordingly the pulley 52 remains relatively stable in order to facilitate its interconnection with a prime mover such as the motor indicated at 54 in FIG. 3. As may be seen in FIG. 3, a similar pulley 56 on the motor 54 is interconnected with the pulley 52 on the drive shaft 30 by means of a belt 58 passing through an opening 59 in the mandrel (see FIG. 2).

Before describing the upper and lower cones or collars 14 and 16, it is noted that the collars have generally the same internal configuration as the mandrel 18. For example, in the embodiment of FIGS. 1–4, both the mandrel 18 and the openings 22 and 24 formed by the upper and lower collars are of the square or rectangular configuration. However, it will be obvious that any of a variety of shapes are contemplated for the mandrel and upper and lower collars in accordance with the present invention. In addition to the round configuration described below in connection with the embodiment of FIG. 5, other multi-sided configurations would also be possible.

Referring again to FIGS. 1–4, the upper collar 14 is mounted upon the supporting framework 12 by means of upper and lower frame members 60 and 62. The collar 14 includes a square or rectangular housing 64. A lower portion 66 of the housing extends generally parallel with the normal axis of the mandrel 18. An upper portion 68 of the housing 64 tapers upwardly and outwardly in order to form a mouth or chute 70 for communicating rock or other material to be crushed into the opening 22 formed between the mandrel 18 and the lower housing portion 66 where the crushing action for the upper collar primarily occurs.

In order to better adapt both the mandrel and the upper collar 14 for operation over long periods of time, hardened liner plates 72, 74 and 76 are replaceably secured to surfaces of the mandrel 18, the upper housing portion 68 and the lower housing portion 66 in order to protect those components from interaction with rock or other material being crushed.

The lower collar 16 is of substantially similar construction as the upper collar 14 except that the spacing between the lower collar 16 and the mandrel 18 may for example, be somewhat reduced in order to improve performance of the crusher or adapt it for double-pass operation as was described in greater detail above.

In any event, the lower collar 18 also includes a housing 78 having lower and upper portions 80 and 82 similar to the lower and upper portions 66 and 80 of the housing 64 described above. The upper portion 82 of the housing similarly forms a chute 84 for communicating rock or other material to be crushed into the opening 24 formed between the lower end of the mandrel 18 and the lower housing portion 80. Liner plates 86, 88 and 90 are similarly secured in replaceable fashion to the lower end of the mandrel 18, the upper housing portion 82 and the lower housing portion 80 in order to protect those components from abrasive wear.

The housing 78 of the lower collar 16 is also mounted upon the supporting framework 12 by means of upper and lower frame members 92 and 94.

The mounting assembly 20 which is designed to permit floating movement of the mandrel 18 includes a surrounding plate 96 which is spaced apart from the mandrel 18 and interconnected thereto by webs 98 in order to permit the flow of rock or other crushed material from the opening 22 in the upper collar into the chute 84 for the lower collar. The plate 96 supports the mandrel 18 for oscillatory movement in the manner described above by means of a plurality of upper and lower springs 100 and 102. The upper springs 100 are arranged about the periphery of the plate 96 and interact between the plate 96 and the lower frame member 62 of the upper collar 16 by means of blocks 104. The lower springs 102 are similarly arranged about the periphery plate 96 while being adapted for interaction between the plate 96 and the upper frame member 92 of the lower collar 16 by means of similar blocks 106. With the mandrel 18 being mounted in floating relation by the springs 100 and 102 through the plate 96, it is accordingly free to follow the gyratory paths of movement described above.

The crusher 10 is also adapted to facilitate replacement of the liner plates 72–76 and 86–90 as necessary. For this reason, various components of the crusher are of generally modular construction in order to facilitate disassembly of the crusher for example to facilitate replacement of the liner plates or for other repairs or the like. Referring particularly to FIG. 3, it may be seen that the upper and lower frame members 60 and 62 of the upper collar are square or rectangular and are sized to nest within angle irons 108 forming a portion of the supporting framework 12. Thus, the entire upper collar assembly may be readily lifted upwardly in order to better expose the upper end of the mandrel 18 and the mounting assembly 20. With the plate 96 in the mounting assembly 20 being a similar square or rectangular configuration, it also is adapted for nested arrangement within the angle irons 108 in the same manner as the upper collar 14. Accordingly, the plate 96 together with the mandrel 18 may also be readily removed from the crusher in order to expose internal surfaces of the lower collar 16. Thus, because of the modular and nested configuration of the crusher, particularly the upper collar 14 and the mandrel 18 together with the mounting assembly 20, necessary repairs such as replacement of the various liner plates can be readily accomplished.

The method of operation for the crusher 10 is believed apparent from the preceding description. With the crusher 10 being formed and assembled in the manner described above, rock, gravel, ore to be crushed is fed into the upper chute 70 after the crusher is set in operation. Operation of the crusher is initiated by actuating the motor 54 or other drive means in order to drive the shaft 30 in rotation whereby the eccentric masses 44 and 46 cause the ends of the mandrel to gyrate relative to the upper and lower collars for producing the novel vibratory crushing effect of the present invention.

Referring now to FIG. 5, another embodiment of the invention is generally indicated at 10', various components of the crusher 10' being indicated by primed numerals corresponding to numerical labels referred to above in connection with the embodiment of FIGS. 1–4. The crusher 10' differs primarily from the crusher 10 of FIGS. 1–4 in that the mandrel 18' and the upper and lower collars 14' and 16' are of cylindrical or conical configuration as opposed to the square or rectangular configuration of the corresponding components in the crusher 10.

At the same time, it is also important to note that where the sides of the mandrel 18 in FIGS. 1–4 as represented by the plates 72 are parallel to the axis of the mandrel with both the upper and lower cones tapering downwardly and inwardly, both the mandrel 18' and the upper and lower cones 14' and 16' of FIG. 5 taper in opposite directions. In particular, the upper end 48' of the mandrel and the housing portion 64' for the upper cone both taper inwardly and downwardly. On the other hand, the lower end 50' of the mandrel and the housing portion 78' taper downwardly and outwardly.

The mounting assembly 20' which supports the mandrel 18 in a floating manner for gyratory movement relative to both the upper and lower cones 14' and 16', is connected with the lower end of the mandrel 18'. The motor 54' is also arranged below the mounting assembly 20'. A drive shaft 110 for the motor 54' is interconnected with a protruding portion 112 of the shaft 30' by means of a flexible drive connection such as a drive shaft 114 including a universal joint or the like (not shown).

Otherwise, additional construction features and the mode of operation for the crusher 10' of FIG. 5 is believed apparent from the preceding description.

Additional modifications and variations are believed obvious in addition to those specifically described above in connection with both the crusher 10 of FIGS. 1–4 and the crusher 10' of FIG. 5. For example, in each of the upper and lower cones or collars 14 and 16 of FIGS. 1–4, the lower housing portion 66 or 80 as well as the corresponding liner plates could be similarly inclined relative to the surface of the mandrel 18 in the same manner as the upper housing portions 64 and 78. Such variations could be desirable in different crushing applications. At the same time, the various angular configurations provided in the two embodiments 10 and 10' of FIGS. 1–4 and 5 respectively suggest other angular configurations possible both within the mandrel 18 or 18' as well as in the upper and lower cones or collars 14 or 14' and 16 or 16'. Accordingly, the scope of the present invention is defined only by the following appended claims.

What is claimed is:

1. A crusher comprising a supporting frame structure, first and second reaction collars mounted in spaced apart relation upon said structure, an elongated mandrel having a shaft extending along an axis of said mandrel and supported for rotation relative to said mandrel by bearing means, eccentric masses being mounted in opposed offset relation on opposite ends of said shaft, resilient support means providing floating support for said mandrel with its opposite ends respectively arranged within said first and second spaced apart reaction collars, and drive means for driving said shaft in rotation whereby the eccentric masses on said shaft cause the ends of said mandrel to gyrate relative to the reaction collars for producing a vibratory crushing effect therebetween.

2. The crusher of claim 1 wherein the axes of said mandrel and said upper and lower collars are vertically arranged to permit passage of material to be crushed through the crusher under the influence of gravity.

3. The crusher of claim 1 wherein said opposed eccentric masses are balanced with respect to each other so that opposite ends of said mandrel gyrate in balanced opposition to each other.

4. The crusher of claim 3 wherein said eccentric masses are further selected with respect to the weight of said mandrel, the length of said mandrel and the spacing of said eccentric masses on said shaft being selected in order to regulate the gyratory path followed by the opposite ends of said mandrel.

5. The crusher of claim 1 wherein said resilient support means comprises spring means interconnecting a central portion of said mandrel with said supporting frame structure.

6. The crusher of claim 5 wherein said drive means comprises a flexible drive element interconnected with said shaft for forming a driving connection which is generally independent of gyratory motion at opposite ends of said mandrel.

7. The crusher of claim 1 wherein said resilient support means is connected to an end of said mandrel.

8. The crusher of claim 1 wherein said first and second reaction collars are at least partly inclined relative to adjacent surface portions of said mandrel.

9. The crusher of claim 8 wherein the axes of said mandrel and said first and second reaction collars are arranged with their axes generally vertical in order to permit passage of material to be crushed through said crusher under the influence of gravity, each of said upper and lower collars including a portion inclined downwardly and toward said mandrel to form a chute for receiving material, a lower portion of each of said reaction collars forming an opening with adjacent surface portions of said mandrel wherein crushing action is effected by gyratory movement of said mandrel.

10. The crusher of claim 1 wherein each of the upper and lower collars and adjacent surface portions of said mandrel taper relative to each other in order to facilitate the passage and crushing of material therebetween.

11. The crusher of claim 1 wherein each of said first and second collars and said mandrel are of multi-sided configuration.

12. The crusher of claim 11 wherein both of said first and second collars and said mandrel are of generally square configuration.

13. The crusher of claim 1 wherein both of said first and second collars and said mandrel are of circular configuration.

14. The crusher of claim 13 wherein at least portions of said first and second reaction collars and adjacent surface portions of said mandrel taper conically with respect to each other in order to facilitate passage and crushing of material therebetween.

15. The crusher of claim 1 further comprising liner plates replaceably mounted on internal surfaces of said first and second reaction collars and adjacent surface portions of said mandrel.

16. The crusher of claim 1 wherein selected portions of the crusher are of modular construction to facilitate removal for repair purposes.

17. The crusher of claim 16 being vertically arranged, an upper collar being formed as a modular unit adapted for nested relation with said supporting frame structure to facilitate its temporary removal from the crusher.

18. The crusher of claim 17 wherein said mandrel and said support means is also of modular construction adapted for nested arrangement upon said supporting frame structure to facilitate its temporary removal from the crusher.

19. The crusher of claim 18 wherein internal surfaces of said first and second collars as well as adjacent surface portions of said mandrel have liner plates replaceably mounted thereon, said modular nested relation of said upper collar and said mandrel with said support means facilitating replacement of said liner plates.

* * * * *